US011952550B1

(12) United States Patent
Wang et al.

(10) Patent No.: US 11,952,550 B1
(45) Date of Patent: Apr. 9, 2024

(54) LUBRICANT FOR COPPER ALLOY DIE-CASTING DIE AND PREPARATION AND USE METHODS THEREOF

(71) Applicant: XIAMEN JJD MACHINERY CO.,LTD, Xiamen (CN)

(72) Inventors: Shenghua Wang, Xiamen (CN); Binglin You, Xiamen (CN); Jialin Wang, Xiamen (CN)

(73) Assignee: XIAMEN JJD MACHINERY CO., LTD, Xiamen (CN)

( * ) Notice: Subject to any disclaimer, the term of this patent is extended or adjusted under 35 U.S.C. 154(b) by 0 days.

(21) Appl. No.: 18/209,479

(22) Filed: Jun. 14, 2023

(51) Int. Cl.

| | |
|---|---|
| ***C10M 169/04*** | (2006.01) |
| ***C10M 105/12*** | (2006.01) |
| ***C10M 105/24*** | (2006.01) |
| ***C10M 105/38*** | (2006.01) |
| ***C10M 107/32*** | (2006.01) |
| ***C10M 111/04*** | (2006.01) |
| ***C10M 125/10*** | (2006.01) |
| ***C10M 125/20*** | (2006.01) |
| ***C10M 125/26*** | (2006.01) |
| ***C10M 177/00*** | (2006.01) |
| *C10N 40/20* | (2006.01) |
| *C10N 50/02* | (2006.01) |
| *C10N 70/00* | (2006.01) |

(52) U.S. Cl.
CPC ..... *C10M 169/04* (2013.01); *C10M 105/12* (2013.01); *C10M 105/24* (2013.01); *C10M 105/38* (2013.01); *C10M 107/32* (2013.01); *C10M 111/04* (2013.01); *C10M 125/10* (2013.01); *C10M 125/20* (2013.01); *C10M 125/26* (2013.01); *C10M 177/00* (2013.01); *C10M 2201/061* (2013.01); *C10M 2201/062* (2013.01); *C10M 2201/087* (2013.01); *C10M 2201/105* (2013.01); *C10M 2207/0215* (2013.01); *C10M 2207/126* (2013.01); *C10M 2207/2835* (2013.01); *C10M 2209/1013* (2013.01); *C10N 2040/243* (2020.05); *C10N 2040/245* (2020.05); *C10N 2050/02* (2013.01); *C10N 2070/00* (2013.01)

(58) Field of Classification Search
CPC ..... C10M 169/04; C10M 105/12; C10M 105/24; C10M 105/38; C10M 107/32; C10M 111/04; C10M 125/10; C10M 125/20; C10M 125/26; C10M 177/00; C10M 2201/105; C10M 2207/0215; C10M 2207/126; C10M 2207/2835; C10M 2209/1013; C10N 2040/243; C10N 2040/245; C10N 2070/00
USPC ..... 508/107
See application file for complete search history.

(56) References Cited

U.S. PATENT DOCUMENTS

2016/0046501 A1* 2/2016 Kverel ..... C01G 41/00 977/734

* cited by examiner

*Primary Examiner* — Prem C Singh
*Assistant Examiner* — Francis C Campanell

(57) ABSTRACT

A lubricant for a copper alloy die-casting die is mainly prepared by an inorganic nano-powder, an organic substrate material, and an organic resin material. In the present disclosure, the use of oil-based lubricants as a basis and the reduction of the content of oil in the lubricant yield improved oil selection and proportion, which cooperates with the corresponding higher proportion of inorganic powder material mixture and a more suitable spraying amount applied on the surface of the die to exert a good lubricating effect on products with complex and irregular shapes in the inner cavity of a die-casting die. At the same time, the production cost of the lubricant is low. Copper alloy die castings produced after a lubrication process have a high yield rate and smooth surfaces without casting defects.

7 Claims, No Drawings

LUBRICANT FOR COPPER ALLOY DIE-CASTING DIE AND PREPARATION AND USE METHODS THEREOF

CROSS-REFERENCE TO RELATED APPLICATIONS

This application is based upon and claims priority to Chinese Patent Application No. 202310473348.1, filed on Apr. 27, 2023, the entire content of which is incorporated herein by reference.

TECHNICAL FILED

The present disclosure relates to the technical field of die-casting lubricants, and in particular to a lubricant for a copper alloy die and preparation and use methods thereof.

BACKGROUND

Die-casting mold cores used for making brass die-cast articles are generally made of hot-working die materials—namely, 3Cr2W8V, H13, 8407, 8418, 2344 and other die steels. Dies made of these materials have short service life, the average service life being 1000-2000 pieces. Sometimes, the dies may undergo early failure due to cracks after running 500-700 pieces.

The main reason for the short service life of these dies is because the dies are used in severe conditions with some die-casting materials to be poured have a temperature higher than 950° C. Although there is a cooling system in the mold core, the temperature therein is generally higher than 500° C. Moreover, in current production processes, lubrication is implemented by spraying water-soluble lubricating fluids or graphite emulsion on the dies.

For example, Chinese patent having the publication number of CN106350190B discloses a high-grade high-speed copper wire drawing lubricant and its preparation method. Oil agent, phosphorus-containing extreme pressure agent, and emulsifying agent are heated to 100-120° C. and added with 90-100° C. water while stirring, followed by cooling to a temperature below 40° C., adding anti-corrosion and anti-rust agent, anti-fungal agent, and anti-foaming agent, and stirring evenly to yield the product.

The water-based lubricant has good lubricating performance and can accelerate the drawing processing of high-strength brass-plated steel wire and reduce die loss to a certain extent. However, the lubricant has mediocre heat insulation performance and high price and can only be used in some positions for local cooling. If the casting is large in size, the die is complicated in shape, and the product is uneven in thickness, the die undergoing frequently local thermal expansion and contraction is prone to early crack failure.

However, the processing cycle of die-casting dies is as long as two to three months. Early crack failure leads to short service life. The expense spent on dies for each product is high, which affects balanced production, increases production cost, and brings great production pressure to enterprises.

SUMMARY

In view of the above technical problems and to overcome the shortcomings of the prior art, the present disclosure provides a lubricant for a copper alloy die-casting die and preparation and use methods thereof.

Technical effect: the lubricant has a good lubricating effect on products with complex and irregular shapes in the inner cavity of a die-casting die, and at the same time, the production cost of the lubricant is low. Copper alloy die castings produced after a lubrication process have a high yield rate and smooth surfaces without casting defects. Meanwhile, the lubricant, compared to the existing lubricants, can greatly prolong the service life of mold core, shows significant superiority, and is pretty suitable for being used in the copper alloy die-casting process.

The present disclosure further defines the technical solution as follows:

A lubricant for a copper alloy die-casting die, prepared by mixing the following components in parts by weight:

20-30 parts of an inorganic nano-powder,
50-65 parts of an organic substrate material, and
6-13 parts of an organic resin material;
where, the organic substrate material accounts for 50-65%, in parts by weight, of all substances;
the lubricant is sprayed onto the surface of the die at the spraying amount of 0.0001 ml/cm$^2$-0.6 ml/cm$^2$.

Further, the organic substrate material is prepared by mixing the following components in parts by weight:

20-37 parts of a glycerin fatty acid ester,
30-38 parts of an unsaturated higher glycerin fatty acid ester,
24-35 parts of a free fatty acid, and
15-25 parts of a free fatty alcohol.

In the above lubricant for a copper alloy die-casting die, the inorganic nano-powder is prepared by mixing the following components in parts by weight:

25-40 parts of molybdenum dioxide,
10-16 parts of silicon dioxide,
10-15 parts of tungsten nitride,
1-8 parts of diboron trioxide, and
20-45 parts of hexagonal boron nitride.

In the above lubricant for a copper alloy die-casting die, the components of the inorganic nano-powder have particle sizes as follows:

molybdenum dioxide: 70-85 nm,
silicon dioxide: 50-70 nm,
tungsten nitride: 80-110 nm,
diboron trioxide: 60-70 nm,
hexagonal boron nitride: 90-110 nm.

In the above lubricant for a copper alloy die-casting die, the organic resin material is prepared by mixing the following components in parts by weight:

50-70 parts of a furfuryl alcohol resin,
20-30 parts of a furfural-acetone resin, and
10-25 parts of a furfural-acetone-formaldehyde resin.

In the above lubricant for a copper alloy die-casting die, the organic substrate material accounts for 54-56%, in parts by weight, of all substances.

A preparation method for the above lubricant for the copper alloy die-casting die, used for preparing any of the lubricants for the copper alloy die-casting die described above, specifically including the following steps:

S1, quantitatively weighing the components of the inorganic nano-powder, and adding into a high-speed mixer for stirring evenly at a rotational speed of 2100-3000 r/min for a stirring time of 15-60 min;
S2, quantitatively weighing and mixing the components of the organic substrate material; and quantitatively weighing and mixing the components of the organic resin material;
S3, taking the inorganic nano-powder, the organic substrate material, and the organic resin material according to a ratio, first adding the organic substrate material into a grinder, then putting the inorganic nano-powder and the organic resin material in sequence at a uniform speed for mixing to make a mixture, and adding yttrium-stabilized zirconia balls into the grinder during the mixing to grind the mixture into a finished lubricant by ball milling;

where, the mass ratio of the mixture to the yttrium-stabilized zirconia balls is 1:6.

A method of spraying the lubricant for the copper alloy die-casting die, used for spraying any of the lubricants for the copper alloy die-casting die described above onto the die by air pressure spraying, specifically including the following steps:

S1, taking an air pressure spraying machine, adjusting the finished lubricant to a spraying concentration by adding a preset amount of solvent to the finished lubricant, and adjusting the pressure of the pressure tank to be greater than or equal to 0.5 MPa;

S2, adding the lubricant of the target concentration into the air pressure spraying machine, and adjusting the position of the nozzle to implement the spraying at an inclined angle of 20-40° relative to the spraying surface and at the spraying amount of 0.0001 $ml/cm^2$-0.6 $ml/cm^2$.

The solvent used in the method is ethanol or ethyl acetate.

A method of spraying the lubricant for the copper alloy die-casting die, used for spraying any of the lubricants for the copper alloy die-casting die described above onto the die by electrostatic spraying, specifically including the following steps:

S1: adding an electrostatic thinner at an amount of 1-3% of the total mass to the finished lubricant and stirring uniformly to the specified viscosity;

S2: measuring the resistivity of the mixed liquid with an electrostatic detector, and maintaining the resistivity within the range of 5-260 M;

S3: ensuring the operating environment to stay in slight negative pressure and have a relative humidity of 45-55% using an air circulation system;

S4: spraying on the die with a spray gun, where the voltage during the spraying is 80-90 kv, and the distance between the spray gun and a workpiece is kept at 35 cm.

During the electrostatic spraying, the solvent used must be ethanol or ethyl acetate to adjust the viscosity of the lubricant.

The present disclosure has the following advantages:

(1) In the present disclosure, lubricants used in a die during a process are generally oil-based lubricants, emulsions, solid lubricants, water-based lubricants, etc. Oil-based lubricants have been widely used due to their good lubricating effect, low production cost, and extensive source, and the output thereof accounts for more than 90% of all lubricants. As a result, to reduce production and use costs, the present disclosure chooses to make improvements on oil-based lubricants. In common oil-based lubricants, based oil serves as the main component, the proportion of which reaches 60-90%, even 97%.

The ensuing questions are as follows: Although the more the base oil used, the better the lubricating effect, the oil is prone to adhere to the die due to its poor polarity and strong adhesion to metal. Furthermore, free sulfide or free sulfur in metal or oil reacting with oil at high temperature produces organic acids and inorganic acids, which is highly corrosive to metal dies and leads to oil sludge formation, contaminates the surface of metal dies and increases wear and tear, and thereby damages the dies. In addition, the addition of additives and resins results in the increase in oil content, which makes the lubricant overall have high heating rate and high limit temperature. As such, resin materials are likely to stick to the surface of the dies due to rapid carbonization of the resin materials at high temperature, accompanied by the production of a large amount of small molecule gas. Rapid carbonization leads to adhesion on the surface of the die and difficulty in cleaning. After repeated use, the surface of the die may be heated unevenly. Repeated heating and cooling is prone to cracks and thus destroy the entire die. The generation of small molecular gas will affect the quality of die castings to a certain extent.

Therefore, the main idea of the present disclosure is as follows: Changing the type of oil in the oil-based lubricant and reducing the content of oil in the lubricant yield improved oil selection and proportion, which cooperates with the corresponding higher proportion of inorganic powder material mixture and a more suitable spraying amount applied on the surface of the die to improve the heat insulation performance of the lubricate, to reduce the probability of high-temperature carbonization and bonding of the resin material, and to reduce the possibility of free sulfur reacting with oil to form oil sludge by acidification, which thereby decreases the contamination and abrasion to surface of the die, diminishes the damage to the die, improves the uniformity of heating on the surface of the die after repeated use, avoids die cracks caused by repeated heating and cooling, prolongs the service life of the die, and lowers the use and production costs.

(2) In the present disclosure, the oil used is mainly plant-based oil with a certain amount of animal-based oil as supplement. Compared with the currently widely used mineral oil, plant-based oil and animal-based oil are more environmentally friendly and clean and have more available material sources. In addition, mineral oil has a significantly higher content of sulfur-containing compounds and hydrocarbons than animal- and plant-base oils. Therefore, the use of animal- and plant-base oils can better protect the die, reduce acidification and corrosion, and prolong the service life.

Unsaturated higher glycerin fatty acid esters derive from natural plants and have extremely excellent lubricating effect on metals. They can be formulated into an adsorption film on the surface of a metal die and formed into a single-layer film of metallic soap on metal surface along with glycerin fatty acid esters, free fatty acids, and free fatty alcohols, and the interaction between the adsorption film and the single-layer film can improve the overall anti-friction and anti-wear performance of the lubricant. Therefore, the same or even better lubricating effect can be achieved while reducing the amount of oil used. In addition, the combination of unsaturated higher glycerin fatty acid esters, glycerin fatty acid esters, free fatty acids, and free fatty alcohols yields a better workpiece surface, reduces damage to the metal, and protects the die.

(3) In the present disclosure, animal- and plant-base oils, being clean and abundant, are used as the base oil of lubricant, which requires low energy consumption during processing, reduces cost, shows good biodegradability, causes no environmental pollution after use, and meets the development needs of green industry.

(4) In the present disclosure, the proportion of oil used is reduced while the proportion of inorganic nano-powder used is increased. In the present disclosure, molybdenum dioxide and hexagonal boron nitride are mainly used as basic powders with silicon dioxide, tungsten nitride, and diboron trioxide as supplement, which endows the lubricant with excellent heat insulation performance. When the die is heated during the die-casting process, the temperature of the lubricant can be ensured to increase slowly and evenly, and the heat insulation performance is good. The combination of resin materials reduces the overall temperature of the lubricant, preventing the temperature of the resin materials from rising too fast, thereby avoiding rapid carbonization of the resin materials and bonding of the resin materials to the die, and protecting the die and prolonging the service life of the die.

(5) In the present disclosure, the lubricant has a good lubricating effect on products with complex and irregular shapes in the inner cavity of a die-casting die, and at the same time, the production cost of the lubricant is low. Copper alloy die castings produced after a lubrication process have a high yield rate and smooth surfaces without casting defects. Meanwhile, the lubricant, compared to the existing lubricants, can greatly prolong the service life of mold core, shows significant superiority, and is pretty suitable for being used in the copper alloy die-casting process.

DETAILED DESCRIPTION OF THE EMBODIMENTS

The present embodiment provides a lubricant for a copper alloy die-casting die, which is prepared by mixing the following components in parts by weight:

20-30 parts of an inorganic nano-powder,
50-65 parts of an organic substrate material, and
6-13 parts of an organic resin material;
where, the organic substrate material accounts for 50-65%, in parts by weight, of all substances; more preferably, the organic substrate material accounts for 54-56%, in parts by weight, of all substances; most preferably, the organic substrate material accounts for 55%, in parts by weight, of all substances.

The inorganic nano-powder accounts for 27-36%, in parts by weight, of all substances; most preferably, the inorganic nano-powder accounts for 29%, in parts by weight, of all substances. The balance is the organic resin material.

In the present disclosure, the organic substrate material is prepared by mixing the following components in parts by weight:

20-37 parts of a glycerin fatty acid ester,
30-38 parts of an unsaturated higher glycerin fatty acid ester,
24-35 parts of a free fatty acid, and
15-25 parts of a free fatty alcohol.

The inorganic nano-powder is prepared by mixing the following components in parts by weight:

25-40 parts of molybdenum dioxide,
10-16 parts of silicon dioxide,
10-15 parts of tungsten nitride,
1-8 parts of diboron trioxide, and
20-45 parts of hexagonal boron nitride.

The components of the inorganic nano-powder have particle sizes as follows:

molybdenum dioxide: 70-85 nm,
silicon dioxide: 50-70 nm,
tungsten nitride: 80-110 nm,
diboron trioxide: 60-70 nm,
hexagonal boron nitride: 90-110 nm.

The organic resin material is prepared by mixing the following components in parts by weight:

50-70 parts of a furfuryl alcohol resin,
20-30 parts of a furfural-acetone resin, and
10-25 parts of a furfural-acetone-formaldehyde resin.

Based on oil-based lubricants, the present disclosure optimizes the formula and reduces the proportion of oil in the lubricant. To compensate the lowering of lubricating effect of the lubricant caused by oil content reduction, the present disclosure uses plant-base oils as the base oil with a certain amount of animal-base oils as supplement, optimizes the lubricating effect on metal dies, alleviates the lowering of lubricating effect of the lubricant caused by oil content reduction, and ensures the normal lubricating effect in the die-casting process.

Furthermore, inorganic nano-powder is added. The use of inorganic nano-powder with a very high melting point, an adjusted powder proportion, and a controlled powder particle size can increase the dispersion and uniformity of the powder in the lubricant, so that the lubricant can form a dense and good heat insulation layer when used in a high-temperature environment, thereby reducing the heating rate and the limit temperature of the oil-based lubricant and avoiding the bonding of organic resin materials caused by rapid carbonization due to excessive high heating rate of the lubricant.

The organic resin material used in the present disclosure mainly includes furfuryl alcohol resin, furfural-acetone resin, and furfural-acetone-formaldehyde resin. The organic resin material prepared by mixing the above resins has good stability and chemical corrosion resistance, high turbidity resistance, and good stability at high temperature. Therefore, after reducing the oil content, the content of the resin material is correspondingly reduced, which allows carbonization to occur at high temperature with a suitable controllable rate and appropriate carbonization effect. An isolation layer is formed between parts and the die to facilitate part demolding.

Changing the type of oil, reducing the content of oil, and increasing the content of inorganic nano-powder can diminish the sulfur content in the oil and inhibit the generation of oil sludge. The inorganic nano-powder can insulate the heat and control the carbonization efficiency of organic resin material, which avoids uneven heating of some portions of the die caused by carbide bonding thereto when the die is repeatedly heated, reduces erosion to the die, and prolongs the service life of the die.

In the present disclosure, a preparation method for a lubricant for a copper alloy die-casting die is further provided, used for preparing the above lubricant for the copper alloy die-casting die, specifically including the following steps:

S1, quantitatively weighing the components of the inorganic nano-powder, and adding into a high-speed mixer for stirring evenly at a rotational speed of 2100-3000 r/min for a stirring time of 15-60 min;
S2, quantitatively weighing and mixing the components of the organic substrate material; and quantitatively weighing and mixing the components of the organic resin material;
S3, taking the inorganic nano-powder, the organic substrate material, and the organic resin material according to a ratio, first adding the organic substrate material into a grinder, then putting the inorganic nano-powder and the organic resin material in sequence at a uniform speed for mixing to make a mixture, and adding yttrium-stabilized zirconia balls into the grinder during the mixing to grind the mixture into a finished lubricant by ball milling;
where, the mass ratio of the mixture to the yttrium-stabilized zirconia balls is 1:6.

Grinding the mixture with the yttrium-stabilized zirconia balls can make the mixture to the target fineness quickly. The yttrium-stabilized zirconia balls are highly stable and are not prone to react with the mixture, which can ensure the fineness of the powder, improve the dispersion, and enhance the lubricating effect of the lubricant during use and the protection effect on the die.

When in use, the lubricant is applied onto the surface of the die by spraying at a spraying amount of 0.0001 ml/cm$^2$-0.6 ml/cm$^2$. Therefore, the present disclosure further discloses two methods of spraying the lubricant onto the die for spraying the above lubricant for the copper alloy die-casting die onto the die.

The first method is conducted with an air pressure spraying machine, specifically including the following steps:

S1, taking an air pressure spraying machine, adjusting the finished lubricant to a spraying concentration by adding a preset amount of solvent to the finished lubricant, and adjusting the pressure of the pressure tank to be greater than or equal to 0.5 Mpa;

S2, adding the lubricant of the target concentration into the air pressure spraying machine, and adjusting the position of the nozzle to implement the spraying at an inclined angle of 20-40° relative to the spraying surface and at the spraying amount of 0.0001 ml/cm$^2$-0.6 ml/cm$^2$.

The solvent used is ethanol or ethyl acetate.

When spraying, controlling the inclined angle at 20-40° can prevent the lubricant from being sprayed out of the predetermined area during the spraying process, improve the spraying uniformity and goodness, and enhance the control degree of the spraying amount. Oil substances are generally soluble in solvent, and using ethanol or ethyl acetate to adjust the concentration allows rapid volatilization after spraying, which ensures the sticking of the lubricant to the surface of the die to improve the use effect of the lubricant.

The second method is conducted with electrostatic spraying, specifically including the following steps:

S1: adding an electrostatic thinner at an amount of 1-3% of the total mass to the finished lubricant and stirring uniformly to the specified viscosity;

S2: measuring the resistivity of the mixed liquid with an electrostatic detector, and maintaining the resistivity within the range of 5-260 M;

S3: ensuring the operating environment to stay in slight negative pressure and have a relative humidity of 45-55% using an air circulation system;

S4: spraying on the die with a spray gun, where the voltage during the spraying is 80-90 kv, and the distance between the spray gun and a workpiece is kept at 35 cm.

During the electrostatic spraying, the solvent used must be ethanol or ethyl acetate to adjust the viscosity of the lubricant.

Because oils tend to produce small molecular bubbles at high temperatures, if the lubricant is applied unevenly on the surface of the die, two problems are likely to occur in some positions. The first is that the local temperature rises too fast, and the organic resin material therein may be carbonized too quickly, causing carbides to bond to the die. The second is that lots of small molecule bubbles are produced in some areas, which affects the quality of parts produced during the die-casting process.

Therefore, through the above two spraying methods, controlling the spraying amount at 0.0001 ml/cm$^2$-0.6 ml/cm$^2$ can suppress the generation of small molecule bubbles while ensuring the lubrication effect and make the heating efficiency of each portion of the die even, avoiding die cracks caused by repeated uneven heating, thereby protecting the die and prolonging the service life of the die.

In order to verify the lubricating effect of the lubricant of the present disclosure and the effect on prolonging the service life of the die, the present disclosure has carried out several tests with different embodiments.

Embodiment 1

Experimental equipment: 3Cr2W8V steel brass test bar die-casting die.

The components of the lubricant include:

an organic substrate material having a mass fraction of 55%, an inorganic nano-powder having a mass fraction of 29%, and an organic resin material having a mass fraction of 16%.

The spraying amount of the lubricant: 0.1 ml/cm$^2$.

Spraying method: air pressure spraying method described in the present disclosure.

Specific test method: 10 die-casting dies are taken to prepare brass test bars by die casting. Before each die casting, the lubricant is sprayed onto the surface of the die at the spraying amount of 0.1 ml/cm$^2$ by air pressure spraying, and after completing each die casting, the die is cooled at a uniform speed. The die is checked whether there are cracks and other defects. The above operations are repeated until the die is scrapped. The average number of times of use of the 10 die-casting dies is counted, and the yield rate of the brass test bars produced by die casting is recorded and averaged.

Embodiment 2

The difference from Embodiment 1 is that the spraying method is the electrostatic spraying in the present disclosure.

Embodiment 3

The difference from Embodiment 1 is that the components of the lubricant include:

an organic substrate material having a mass fraction of 50%, an inorganic nano-powder having a mass fraction of 27%, and an organic resin material having a mass fraction of 23%.

Embodiment 4

The difference from Embodiment 1 is that the components of the lubricant include:

an organic substrate material having a mass fraction of 58%, an inorganic nano-powder having a mass fraction of 36%, and an organic resin material having a mass fraction of 6%.

Embodiment 5

The difference from Embodiment 1 is that the components of the lubricant include:

an organic substrate material having a mass fraction of 54%, an inorganic nano-powder having a mass fraction of 30%, and an organic resin material having a mass fraction of 16%.

Embodiment 6

The difference from Embodiment 1 is that the components of the lubricant include:

an organic substrate material having a mass fraction of 56%, an inorganic nano-powder having a mass fraction of 32%, and an organic resin material having a mass fraction of 12%.

Embodiment 7

The difference from Embodiment 1 is that the components of the lubricant include:

an organic substrate material having a mass fraction of 58%, an inorganic nano-powder having a mass fraction of 34%, and an organic resin material having a mass fraction of 8%.

Embodiment 8

The difference from Embodiment 1 is that the experimental equipment is H13 steel brass test bar die-casting die.

Embodiment 9

The difference from Embodiment 1 is that the experimental equipment is 8407 steel brass test bar die-casting die.

Embodiment 10

The difference from Embodiment 1 is that the spraying amount of the lubricant is 0.5 ml/cm$^2$.

Comparative Example 1

The difference from Embodiment 1 is that a commercially available common water-based lubricant is used.

After several experiments, the data obtained are shown in Table 1.

TABLE 1

Number of times of use of dies and product pass rate in different embodiments

| Item | Number of times of use when scrap (times) | Reason of die failure | Yield rate of die castings % | Number of die castings with defects (piece) | Surface roughness of die castings (Ra) |
|---|---|---|---|---|---|
| Embodiment 1 | 4833 | Early thermal cracking | 99 | 47 | 3.2 |
| Embodiment 2 | 4698 | Surface cracks | 96 | 182 | 3.2 |
| Embodiment 3 | 4206 | Thermal cracking surrounding thimble hole | 94 | 253 | 6.4 |
| Embodiment 4 | 3544 | Surface peeling | 93 | 249 | 6.4 |
| Embodiment 5 | 4339 | Early cracking | 95 | 217 | 3.2 |
| Embodiment 6 | 4018 | Cracks | 95 | 199 | 6.4 |
| Embodiment 7 | 3794 | Surface peeling | 93 | 266 | 6.4 |

TABLE 1-continued

Number of times of use of dies and product pass rate in different embodiments

| Item | Number of times of use when scrap (times) | Reason of die failure | Yield rate of die castings % | Number of die castings with defects (piece) | Surface roughness of die castings (Ra) |
|---|---|---|---|---|---|
| Embodiment 8 | 4503 | Cracks | 98 | 89 | 3.2 |
| Embodiment 9 | 4722 | Collapse of bulge | 98 | 95 | 3.2 |
| Embodiment 10 | 4215 | Surface cracking | 98 | 84 | 6.4 |
| Comparative Example 1 | 1788 | Surface bursting | 92 | 143 | 12.5 |

The above table shows that the lubricant used in Embodiment 1 results in the highest yield rate of die castings, the least number of die castings with defects, the smallest surface roughness of die castings, the most number of times of use of die when scrap, the longest service life of die, and the highest die-casting quality. Therefore, the lubricant obtained according to the component ratio in Embodiment 1 has the optimal lubricating effect. Compared with the common water-based lubricant, using the lubricant of the present disclosure in conjunction with the spraying method disclosed in the present disclosure can extend the service life of die by more than two times, and the use effect is excellent.

In addition to the above-mentioned embodiments, the present disclosure can also have other implementations. All technical solutions formed by equivalent replacement or equivalent transformation fall within the scope of protection of the present disclosure.

What is claimed is:

1. A lubricant for a copper alloy die-casting die, prepared by mixing the following components in parts by weight:

20-30 parts of an inorganic nano-powder, 50-65 parts of an organic substrate material, and 6-13 parts of an organic resin material;

wherein the organic substrate material accounts for 50-65%, in parts by weight, of all substances of the lubricant;

the components of the inorganic nano-powder comprise all of the following and have the following particle sizes:

molybdenum dioxide: 70-85 nm, silicon dioxide: 50-70 nm, tungsten nitride: 80-110 nm, diboron trioxide: 60-70 nm, hexagonal boron nitride: 90-110 nm;

the lubricant is sprayed onto the surface of the die at the spraying amount of 0.0001 ml/cm2-0.6 ml/cm$^2$.

2. The lubricant for the copper alloy die-casting die according to claim 1, wherein the components of the inorganic nano-powder have particle sizes as follows:

molybdenum dioxide: 70-85 nm, silicon dioxide: 50-70 nm, tungsten nitride: 80-110 nm, diboron trioxide: 60-70 nm, hexagonal boron nitride: 90-110 nm.

3. The lubricant for the copper alloy die-casting die according to claim 1, wherein the organic resin material is prepared by mixing the following components in parts by weight:

50-70 parts of a furfuryl alcohol resin, 20-30 parts of a furfural-acetone resin, and 10-25 parts of a furfural-acetone-formaldehyde resin.

4. The lubricant for the copper alloy die-casting die according to claim 1, wherein the organic substrate material accounts for 54-56%, in parts by weight, of all substances of the lubricant.

5. A preparation method for a lubricant for a copper alloy die-casting die, used for preparing the lubricant for the copper alloy die-casting die according to claim 1, specifically comprising the following steps:

S1, quantitatively weighing the components of the inorganic nano-powder, and adding into a high-speed mixer for stirring evenly at a rotational speed of 2100-3000 r/min for a stirring time of 15-60 min;

S2, quantitatively weighing and mixing the components of the organic substrate material; and quantitatively weighing and mixing the components of the organic resin material;

S3, taking the inorganic nano-powder, the organic substrate material, and the organic resin material according to a ratio, first adding the organic substrate material into a grinder, then putting the inorganic nano-powder and the organic resin material in sequence at a uniform speed for mixing to make a mixture, and adding yttrium-stabilized zirconia balls into the grinder during the mixing to grind the mixture into a finished lubricant by ball milling;

wherein the mass ratio of the mixture to the yttrium-stabilized zirconia balls is 1:6.

6. A method of spraying a lubricant for a copper alloy die-casting die, used for spraying the lubricant for the copper alloy die-casting die according to claim 1 onto the die by air pressure spraying, specifically comprising the following steps:

S1, taking an air pressure spraying machine, adjusting the finished lubricant to a spraying concentration by adding a preset amount of solvent to the finished lubricant, and adjusting the pressure of the pressure tank to be greater than or equal to 0.5 MPa;

S2, adding the lubricant of the target concentration into the air pressure spraying machine, and adjusting the position of the nozzle to implement the spraying at an inclined angle of 20-40° relative to the spraying surface and at the spraying amount of 0.0001 ml/cm2-0.6 ml/cm2;

wherein the solvent used is ethanol or ethyl acetate.

7. A method of spraying a lubricant for a copper alloy die-casting die, used for spraying the lubricant for the copper alloy die-casting die according to claim 1 onto the die by electrostatic spraying, specifically comprising the following steps:

S1: adding an electrostatic thinner at an amount of 1-3% of the total mass to the finished lubricant and stirring uniformly to the specified viscosity;

S2: measuring the resistivity of the mixed liquid with an electrostatic detector, and maintaining the resistivity within the range of 5-260 M;

S3: ensuring the operating environment to stay in slight negative pressure and have a relative humidity of 45-55% using an air circulation system;

S4: spraying on the die with a spray gun, wherein the voltage during the spraying is 80-90 kv, and the distance between the spray gun and a workpiece is kept at 35 cm.

* * * * *